US011851818B2

(12) United States Patent
Opstad et al.

(10) Patent No.: US 11,851,818 B2
(45) Date of Patent: Dec. 26, 2023

(54) INLINE DILUTION OF MICROFIBRILLATED CELLULOSE

(71) Applicant: Borregaard AS, Sarpsborg (NO)

(72) Inventors: Anne Opstad, Sarpsborg (NO); Jarle Wikeby, Sarpsborg (NO); Hans Henrik Øvrebø, Sarpsborg (NO)

(73) Assignee: Borregaard AS, Sarpsborg (NO)

( * ) Notice: Subject to any disclaimer, the term of this patent is extended or adjusted under 35 U.S.C. 154(b) by 516 days.

(21) Appl. No.: 16/644,081

(22) PCT Filed: Sep. 7, 2018

(86) PCT No.: PCT/EP2018/074141

§ 371 (c)(1),
(2) Date: Mar. 3, 2020

(87) PCT Pub. No.: WO2019/048616

PCT Pub. Date: Mar. 14, 2019

(65) Prior Publication Data

US 2020/0318289 A1 Oct. 8, 2020

(30) Foreign Application Priority Data

Sep. 7, 2017 (EP) ..... 17189922

(51) Int. Cl.
*D21H 11/18* (2006.01)
*D21C 9/00* (2006.01)
(Continued)

(52) U.S. Cl.
CPC ..... *D21H 11/18* (2013.01); *D21B 1/36* (2013.01); *D21C 9/00* (2013.01); *D21C 9/007* (2013.01);
(Continued)

(58) Field of Classification Search
CPC ..... D21H 11/18; D21H 21/08; D21H 23/04; D21B 1/36; D21C 9/00
See application file for complete search history.

(56) References Cited

U.S. PATENT DOCUMENTS 3,806,050 A * 4/1974 Cumpston, Jr. ..... D21D 1/22 241/298
4,020,994 A * 5/1977 Cumpston ..... B01J 19/18 241/260
(Continued)

FOREIGN PATENT DOCUMENTS

EP 2196579 A1 6/2010
WO WO-98/29596 A1 7/1998
(Continued)

OTHER PUBLICATIONS

Karppinen, How to characterize microfibrillated cellulose reliably, Oct. 25, 2016, Exliva Borregaard Blog post. (Year: 2016).*
(Continued)

*Primary Examiner* — Anthony Calandra
(74) *Attorney, Agent, or Firm* — Choate, Hall & Stewart LLP; Michael D. Schmitt

(57) ABSTRACT

The present invention relates a process and a system for the point-of-use dilution of microfibrillated cellulose (MFC) from a higher solids content to a lower solids content, for example from a solids content in the range of 5% weight by weight ("w/w")-50% w/w, preferably 5% w/w-30% w/w, further preferably 5% w/w-15% w/w, down to a solids content of below 7% w/w, preferably below 5% w/w, preferably to a solids content of 0.01% w/w-5% w/w, further preferably to a solids content of 0.1% w/w-3% w/w. The process at least comprises the following steps: (i) providing microfibrillated cellulose in a solvent, wherein the solids content is in the range of 5% weight by weight ("w/w")-50% w/w, preferably 5% w/w-30% w/w, further preferably 5
(Continued)

w/w-15% w/w; (ii) subjecting said microfibrillated cellulose from step (i) to a dilution step in a rotor-stator mixer; (iii) simultaneously to step (ii): injecting solvent into the rotor-stator mixer, or into a volume segment upstream of the rotor-stator mixer, in order to lower the solids content of the microfibrillated cellulose in the rotor-stator mixer.

13 Claims, 7 Drawing Sheets

(51) Int. Cl.

| | |
|---|---|
| ***D21D 5/28*** | (2006.01) |
| ***D21H 23/04*** | (2006.01) |
| ***D21B 1/36*** | (2006.01) |
| ***D21H 21/08*** | (2006.01) |
| *D21H 17/53* | (2006.01) |

(52) U.S. Cl.
CPC ..... *D21D 5/28* (2013.01); *D21H 21/08* (2013.01); *D21H 23/04* (2013.01); *D21H 17/53* (2013.01)

(56) References Cited

U.S. PATENT DOCUMENTS

| | | | | |
|---|---|---|---|---|
| 4,341,807 | A | 7/1982 | Turbak et al. | |
| 4,374,702 | A | 2/1983 | Turbak et al. | |
| 4,481,077 | A | 11/1984 | Herrick | |
| 6,202,946 | B1 * | 3/2001 | Virtanen | D21D 1/36 241/23 |
| 2017/0218567 | A1 * | 8/2017 | Kajanto | D21H 11/18 |

FOREIGN PATENT DOCUMENTS

| | | | |
|---|---|---|---|
| WO | WO-2005/005716 | A1 | 1/2005 |
| WO | WO-2006/123010 | A1 | 11/2006 |
| WO | WO-2007/091942 | A1 | 8/2007 |
| WO | WO-2013/072559 | A1 | 5/2013 |
| WO | WO-2014/045209 | A1 | 3/2014 |
| WO | WO-2015/180844 | A1 | 12/2015 |

OTHER PUBLICATIONS

Ika, New: Product Video: Powerful, precise, targeted energy input for all types of samples—the new IKA dispersion systems by IKA , 2021 (Year: 2021).*

Ankerfors, Microfibrillated cellulose: Energy-efficient preparation techniques and key properties,2012, Inventia AB. (Year: 2012).*

* cited by examiner

INLINE DILUTION OF MICROFIBRILLATED CELLULOSE

FIELD OF THE INVENTION

The present invention relates to a process for the point-of-use dilution of microfibrillated cellulose (MFC), from a relatively high solids content, down to a relatively lower solids content, for example from a solids content in the range of 5% weight by weight ("w/w")-50% w/w down to a solids content of below 7% w/w, preferably below 5% w/w, preferably to a solids content of 0.01% w/w-5% w/w, further preferably to a solids content of 0.1% w/w-3% w/w.

BACKGROUND OF THE INVENTION

Microfibrillated cellulose (also known as "reticulated" cellulose or as "superfine" cellulose, or as "cellulose nanofibrils", among others and also referred to as "MFC" in the following) is a cellulose-based product and is described, for example, in U.S. Pat. Nos. 4,481,077, 4,374,702 and 4,341,807. According to U.S. Pat. No. 4,374,702 ("Turbak"), microfibrillated cellulose has reduced length scales (diameter, fibril length) vis-b-vis cellulose fibers, improved water retention and adjustable viscoelastic properties. MFC with further improved properties and/or properties tailor-made for specific applications is known, among others, from WO 2007/091942 and WO 2015/180844.

After manufacture, microfibrillated cellulose as ready for transportation to the point-of-use is typically present as a "paste", i.e. as a suspension of solid microfibrillated fibrils in a solvent, typically in water. This paste (suspension) is neither a liquid nor a solid and has non-Newtonian flow properties (see FIG. 1 for a photograph of microfibrillated cellulose as dewatered to a solids content of 8%-10%).

Typically, MFC is not "concentrated" all the way to a "fully dried" state (and then transported in the dry state to the point-of-use), but rather is ultimately obtained and transported as a suspension with a relatively high solvent (water) content. One reason why MFC is not typically transported as a powder is that the cohesive forces between the microfibrils increase upon complete drying (solvent removal). Thus, the fibril network may aggregate and may not be fully re-dispersed in water anymore, at the final point-of-use.

Microfibrillated cellulose is therefore typically transported as a suspension. Furthermore, microfibrillated cellulose is typically transported as a high viscosity paste-like suspension that may have a relatively high solids content, i.e. a relatively high content of (solid) microfibrillated cellulose, relative to the amount of solvent, than is ultimately required or beneficial for the end use. This may be due to the fact that transportation costs need to be minimized and/or that the microfibrillated cellulose as manufactured has a higher solids content than needed in the application at the point-of-use. Therefore, MFC often needs to be diluted to a lower solids content, at the point-of-use.

Microfibrillated cellulose is used in a wide variety of applications, including but not limited to: coatings, adhesives, (surface) sizes, paints, inks, de-icing fluids or additives, thixotropic additives, emulsifier/emulsion aid; viscosity adjustment, additive in oil field applications, in particular drilling fluids, in home care/personal care/personal hygiene applications, cosmetics and pharmaceutical applications, in particular in ointments, emulsions or high viscosity liquids, as an additive or aid in medical devices or medical applications, in particular scar and wound care, agrochemicals, food applications, for example as thickener, dietary supplement, non-caloric additive, emulsifier etc., in printing applications, including 3-D printing, in composite materials, for example plastics, rubber or paper-based materials, cardboards etc., in or as porous material, foam or aerogel/hydrogel; in separation technologies, including filter elements, membranes, separators etc., in film forming applications, in battery technology and/or flexible electronics, in textile application and/or as filaments, including yarns, non-woven, meshes etc., as an additive or adjuvant in construction commodities, including cement, concrete, gypsum boards, and the like In many applications, MFC is used as an additive, which is added at the beginning or during a given formulation process. In order to take full advantage of the performance of MFC, it may be necessary to disperse and dilute the MFC to the desired or required consistency, for example from a solids content in the range of 5% weight by weight ("w/w")-50% w/w down to a solids content of below 7% w/w, preferably below 5% w/w, preferably to a solids content of 0.01% w/w-5% w/w, further preferably to a solids content of 0.1% w/w-3% w/w.

In case a suitable degree of dilution and subsequent re-dispersion is not adjusted, microfibrils may agglomerate and some of the performance characteristics of the MFC may be diminished.

In accordance with processes known from the art, for initial solid contents larger than 5% w/w, typically a mixing or kneading device ("laboratory device") is used to obtain a homogeneous suspension with the desired concentration. Such known devices are laboratory mixers, laboratory stirrers, blenders and agitators as commercially available, for example from Cole-Parmer or Thermo Fisher Scientific, also including Ultra Turrax homogenizers or Waring blenders.

Known processes for diluting MFC, in particular such processes known to work on the laboratory scale may be difficult to implement at the site of end use, in particular if a larger scale of dilution is required. Also, dilution may not always be reproducible in the sense that it leads to MFC end products that have specified properties after dilution. In some case, dilution may also lead to a deterioration of properties, for example of the water retention properties of MFC.

Based on the above, it is an object of the present invention to provide a process for the point-of-use dilution of MFC, for example from a solids content in the range of 5% weight by weight ("w/w")-50% w/w down to a solids content of below 7% w/w, preferably below 5% w/w, preferably to a solids content of 0.01% w/w-5% w/w, further preferably to a solids content of 0.1% w/w-3% w/w, which process avoids or minimizes any or all of the disadvantages or potential problems as outlined above. In particular, said process should not lead to a loss of water retention capacity of the overall MFC suspension.

SUMMARY OF THE PRESENT INVENTION

The inventors have found that using rotor-stator mixers as commercially available for use in creating stable suspensions at different levels of flow throughput is particularly suitable for inline dilution, i.e. for continuous dilution of MFC, at the point-of-use.

Surprisingly, it was found that even high viscosity pastes, such as microfibrillated cellulose at a solids content of 10% or more (see FIG. 1) could be processed in a rotor-stator mixer.

Further surprisingly, it was found that re-dispersion/activation of MFC is possible in a rotor-stator mixer at a comparatively short residence time.

In accordance with the present invention, at least a subset of the above-stated problems is solved by a process for the dilution of microfibrillated cellulose, from a solids content in the range of 5% weight by weight ("w/w")-50% w/w, preferably 5% w/w-30% w/w, further preferably 5% w/w-15% w/w, down to a solids content of below 7% w/w, preferably below 5% w/w, preferably to a solids content of 0.01% w/w-5% w/w, further preferably to a solids content of 0.1% w/w-3% w/w, wherein said process at least comprises the following steps:

(i) providing microfibrillated cellulose in a solvent, wherein the solids content is in the range of 5% weight by weight ("w/w")-50% w/w, preferably 5% w/w-30% w/w, further preferably 5% w/w-15% w/w;

(ii) subjecting said microfibrillated cellulose from step (i) to a dilution step in a rotor-stator mixer;

(iii) simultaneously to step (ii): injecting solvent into the rotor-stator mixer, or into a volume segment upstream of the rotor-stator mixer, in order to lower the solids content of the microfibrillated cellulose in the rotor-stator mixer.

In accordance with the present invention, injecting "upstream" means injecting the solvent at a location that is situated ahead of the rotor-stator mixer, i.e. the solvent is injected into the system prior to entering the rotor-stator mixer. Correspondingly, "downstream" relates to a location that is situated after the exit of the rotor-stator mixer. Microfibrillated cellulose" (MFC) in accordance with the present invention is to be understood as relating to cellulose fibers that have been subjected to a mechanical treatment resulting in an increase of the specific surface and a reduction of the size of cellulose fibers, in terms of cross-section (diameter) and/or length, wherein said size reduction preferably leads to "fibrils" having a diameter in the nanometer range and a length in the micrometer range.

In accordance with the present invention, other components or additives may be present in the suspension of MFC in a solvent as provided in step (i). The solids content of MFC will be measured, however and at any rate in % w of dry MFC (i.e. MFC as remaining if all solvent is removed) relative to the weight of the solvent(s) as present.

In accordance with the present invention, the "solids content" of MFC is measured by oven drying (105° C., 16 hours) the MFC as present together with the solvent. At least 30 g of sample is weighed into a pre-weighed aluminum weighing dish. The sample is then dried at 105° C. for 16 hours, which removes the solvent. The aluminum weighing dish with the dried matter is weighed, and dry matter is calculated based on the formula [Weight (dish plus sample after drying)−Weight (dish)*100%]/Weight (sample before drying).

In embodiments of the invention, the dilution process of step (ii) occurs in the volume segment defined between at least one stator and at least one rotor. This volume segment is also referred to as the "head" of the rotor-stator mixer.

In embodiments of the invention, in step (ii), the microfibrillated cellulose is subjected to an energy input of from 1 kWh/ton dry MFC-1000 kWh/ton dry MFC, preferably from 10 kWh/ton dry MFC to 700 kWh/ton dry MFC, further preferably 100 kWh/ton dry MFC-400 kWh/ton dry MFC.

In embodiments of the invention, in step (ii), the retention time of the MFC in the rotor-stator mixer is from 0.01 to 30 sec, preferably from 0.02 to 1 sec, further preferably from 0.02 to 0.2 sec.

These retention times are significantly shorter than the mixing or dilution times typically required in standard laboratory mixing and stirring equipment.

In embodiments of the invention, the tip speed of the rotors in the rotor-stator mixer is from 10 m/s to 100 m/s, preferably from 30 m/s to 60 m/s.

In embodiments of the invention, the water retention capacity of the microfibrillated cellulose after step (ii) is higher than the water retention capacity of the microfibrillated cellulose as initially provided in step (i).

The water retention capacity (also referred to as "water holding" capacity) describes the ability of the MFC to retain water within the MFC structure, essentially relating to the accessible surface area.

In embodiments of the invention, the microfibrillated cellulose, after step (ii) and/or step (iii), has a water holding capacity (water retention capacity) of more than 75, preferably more than 80, further preferably more than 100. In embodiments of the invention, the MFC has a water holding capacity of 70-400, preferably 75-250, further preferably 80-150.

The water holding capacity is measured by diluting a given MFC sample to a 0.3% solids content in water and then centrifuging the samples at 1000 G for 15 minutes. The clear water phase was separated from the sediment and the sediment was weighed. The water holding capacity is given as (mV/mT)−1 where mV is the weight of the wet sediment and mT is the weight of dry MFC analyzed.

In embodiments of the present invention, the dilution leads to MFC, after step (ii) and/or after step (iii), which has a complex viscosity in PEG of from 20 Pa s-100 Pa s, preferably 30 Pa s-90 Pa s.

The increased values for the complex viscosity (relative to dilution in standard laboratory equipment) as found for the diluted and reconstituted MFC, in accordance with the present invention, as evidenced, for example by FIGS. 5 and 6, show that the dilution process of the present invention provides an enhanced thickening effect in the resulting suspension.

The complex viscosity in PEG or "PEG viscosity" as used in accordance with the present invention is measured with PEG400 as the solvent at a dosage of 0.65% MFC in PEG/water. The concentration of PEG and water in the suspension, respectively, is 60% and 39%. "PEG 400" is a polyethylene glycol with a molecular weight between 380 and 420 g/mol and is widely used in pharmaceutical applications and therefore commonly known and available. The complex viscosity was measured on a rheometer of the type Anton Paar Physica MCR 301. The temperature in all measurements was 25° C. and a "plate-plate" geometry was used (diameter: 50 mm). The rheological measurement was performed as an oscillating measurement (amplitude sweep), and the complex viscosity in the plateau of the amplitude sweep is measured.

In accordance with the present invention, at least a subset of the above-stated problems is solved by a system for the dilution of microfibrillated cellulose, from a solids content in the range of 5% weight by weight ("w/w")-50% w/w, preferably 5% w/w-30% w/w, further preferably 5% w/w-15% w/w, down to a solids content of below 7% w/w, preferably below 5% w/w, preferably to a solids content of 0.01% w/w-5% w/w, further preferably to a solids content of 0.1% w/w-3% w/w, wherein said system at least comprises the following components:

at least one rotor-stator mixer (2);

at least one line (1) for feeding microfibrillated cellulose into at least one volume segment of said rotor-stator mixer;

at least one process line (3) for injecting solvent into said at least one volume segment of said rotor-stator mixer, or into a volume segment upstream of the rotor-stator mixer.

In accordance with the present invention, at least a subset of the above-stated problems is solved by the use of diluted microfibrillated cellulose obtained or obtainable according to the process of any of the embodiments as disclosed above or obtained with a system of any of the embodiments disclosed herein in or as: coatings, adhesives, (surface) sizes, paints, inks, de-icing fluids or additives, thixotropic additives, emulsifier/emulsion aid; viscosity adjustment, additive in oil field applications, in particular drilling fluids, in home care/personal care/personal hygiene applications, cosmetics and pharmaceutical applications, in particular in ointments, emulsions or high viscosity liquids, as an additive or aid in medical devices or medical applications, in particular scar and wound care, agrochemicals, food applications, for example as thickener, dietary supplement, non-caloric additive, emulsifier etc., in printing applications, including 3-D printing, in composite materials, for example plastics, rubber or paper-based materials, cardboards etc., in or as porous material, foam or aerogel/hydrogel; in separation technologies, including filter elements, membranes, separators etc., in film forming applications, in battery technology and/or flexible electronics, in textile application and/or as filaments, including yarns, non-woven, meshes etc., as an additive or adjuvant in construction commodities, including cement, concrete, gypsum boards, and the like.

As a further advantage, the present process allows for a comparatively high degree of control over the dilution process without the need for a mixing and holding tank, which is of particular importance since the present process is preferably conducted at the point of use. A mixing thank needs to have extensive agitation equipment to compensate for the in line dilution mixing chamber. By comparison, the present process significantly reduces time and typically results in a more even and reproducible dilution/dispersion. Also, foaming problems that typically arise in high energy mixing processes are avoided or limited.

DETAILED DESCRIPTION OF THE INVENTION

The invention is described in more detail in the following, with reference to the enclosed figures, which are only meant to be illustrative, wherein.

In accordance with the present invention, a rotor-stator mixer is any device that comprises at least one rotor that turns at a predetermined speed relative to at least one stationary stator. As the rotating blades pass the stator, they mechanically shear the content, here the MFC as dispersed in a solvent.

Conventionally, a rotor-stator mixer, for example a high-intensity Cavitron® inline mixer is not used for dilution processes, but rather for homogenizing, emulsifying and/or mixing additives into a suspension, in particular a high viscosity suspension. Surprisingly, the inventors have found that not only is inline dilution of high viscosity paste-like MFC possible with such a high intensity rotor-stator mixer, but that such inline dilution also results in improved properties of the resulting diluted MFC, in particular increased water retention capabilities and increased homogeneity, respectively vis-b-vis MFC diluted with conventional laboratory equipment used for stirring, as will be shown in more detail below, in particular in the "Examples"-Section.

Figure 2:
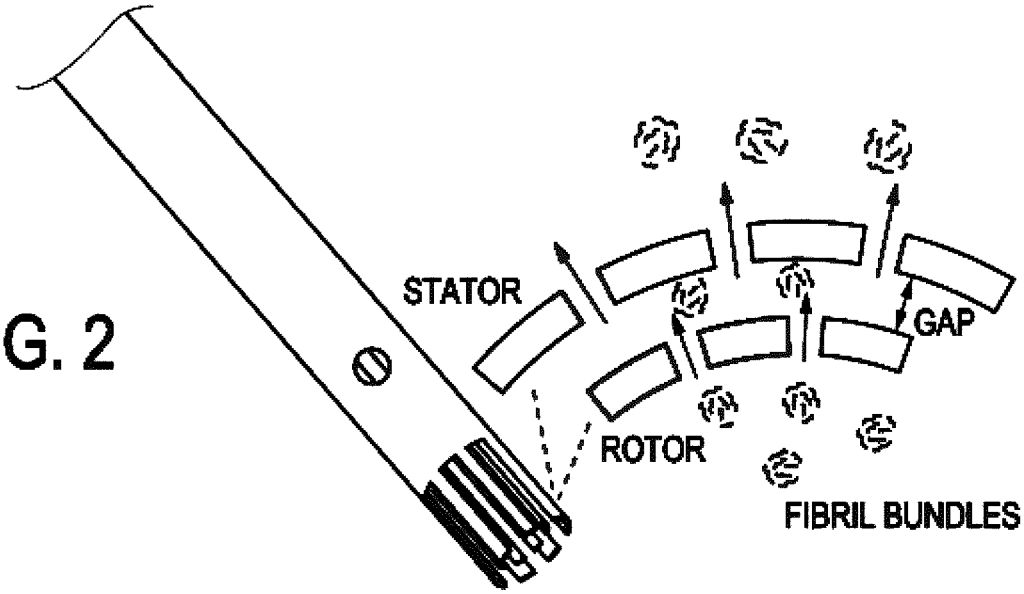
FIG. 2 shows a schematic representation of the "rotor-stator"-principle.

A schematic depiction of the basic set-up of a rotor-stator arrangement is shown in FIG. 2.

Figure 3:
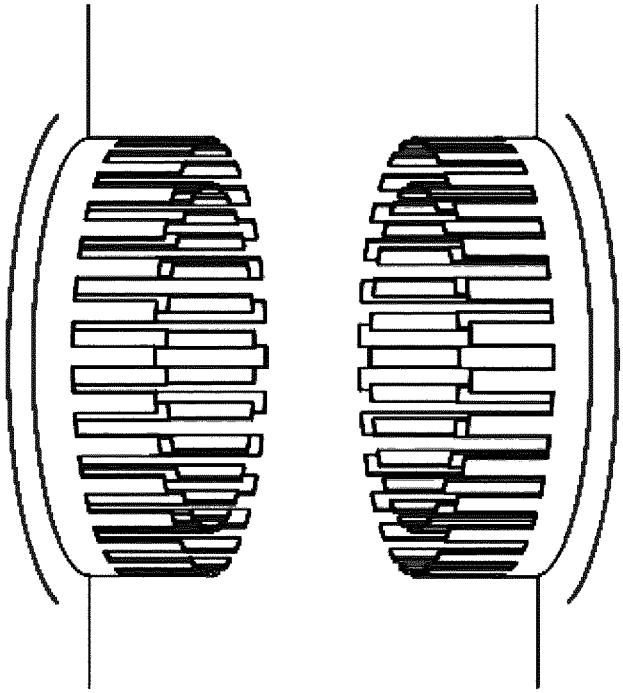
FIG. 3 shows a further exemplary embodiment for a rotor and stator as implemented in a rotor-stator mixer that is exemplary for the present invention.

A more specific embodiment as realized in a Cavitron® rotor-stator mixer is shown in FIG. 3.

A Cavitron rotor-stator mixer typically consists of a series of concentric rings, or chambers. As the MFC paste to be diluted enters the center chamber, it is compressed at a rate of up to 10 bar. One one-thousandth of a second later, the chamber opens, and the medium inside the head of the mixer "explodes" outward into the next chamber. A series of nozzles breaks down the medium as it passes from chamber to-chamber. These nozzles can be as small as 500 microns (0.5 mm), and the rotor/stator segments can meet up to 500 million times per second.

In embodiments of the invention, the rotor-stator mixer includes at least one rotor which rotates at high speed inside at least one stationary stator, which stator is interchangeable and/or adaptable to different process requirements.

In embodiments of the invention, the at least one stator comprises cylindrical screens, preferably having a clearance from the rotor of 1 mm or less, preferably 0.5 mm or less.

In embodiments of the invention, the at least one stator has holes or slots through which the fluid is forced.

The kinetic energy generated by the rotor which is dissipated in the stator region creates comparatively high energy dissipation rates due to the relatively small volume segment present between stator and rotor. Fluid undergoes shear when one area of fluid travels with a different velocity relative to an adjacent area (see FIG. 2).

In embodiments of the invention, the at least one rotor is or comprises a rotating impeller or high-speed rotor, or a series of such impellers or inline rotors (see FIG. 3), preferably powered by an electric motor.

In embodiments of the invention, the speed of the MFC as dispersed in the solvent at the outside diameter of the rotor is higher than the velocity at the center of the rotor, and it is this velocity difference that creates shear.

Relevant parameters describing the performance of the rotor-stator mixer of the present invention include the diameter of the rotor and its rotational speed ("tip speed").

In accordance with the present invention, at least a subset of the above-stated problems is solved by a system for the dilution of microfibrillated cellulose, from a solids content in the range of 5% weight by weight ("w/w")-50% w/w, preferably 5% w/w-30% w/w, further preferably 5% w/w-15% w/w, down to a solids content of below 7% w/w, preferably below 5% w/w, preferably to a solids content of 0.01% w/w-5% w/w, further preferably to a solids content of 0.1% w/w-3% w/w, wherein said system at least comprises the following components:

at least one rotor-stator mixer (2);

at least one line (1) for feeding microfibrillated cellulose into at least one volume segment of said rotor-stator mixer;

at least one process line (3) for injecting solvent into said at least one volume segment of said rotor-stator mixer or into a volume segment upstream of the rotor-stator mixer.

Figure 4:
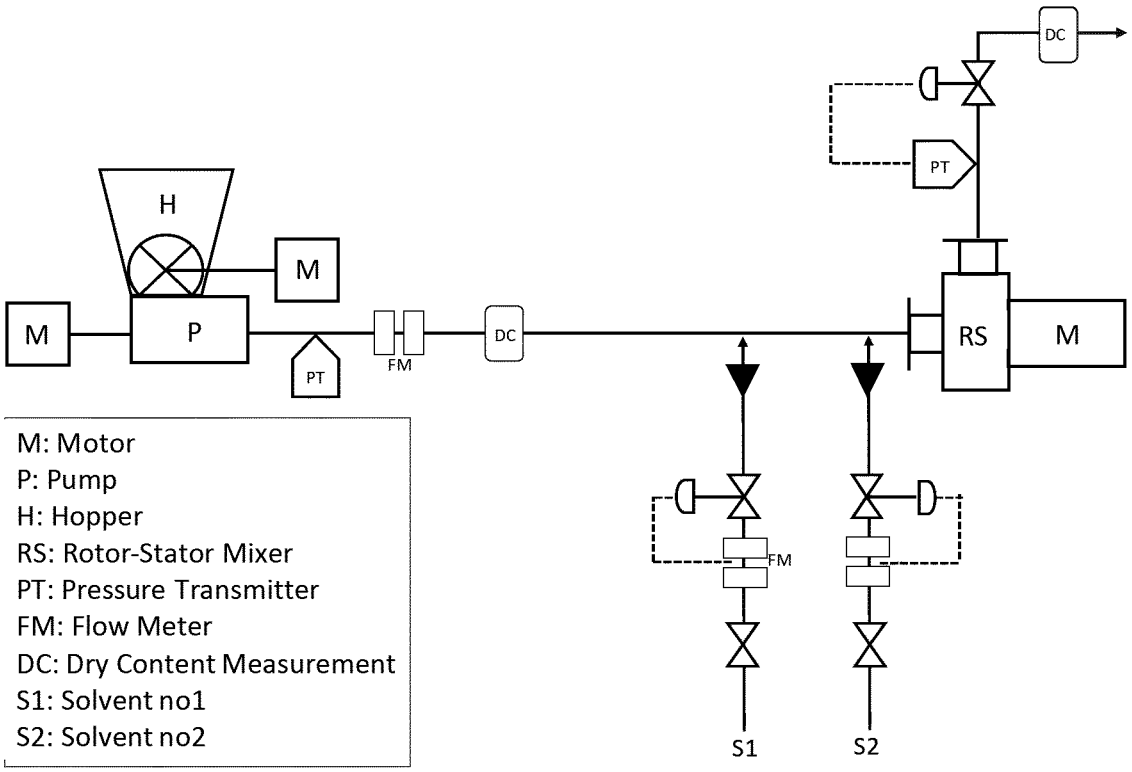
FIG. 4 shows an exemplary flow diagram of the process, including various components of the system, in accordance with the present invention.
Figure 7:
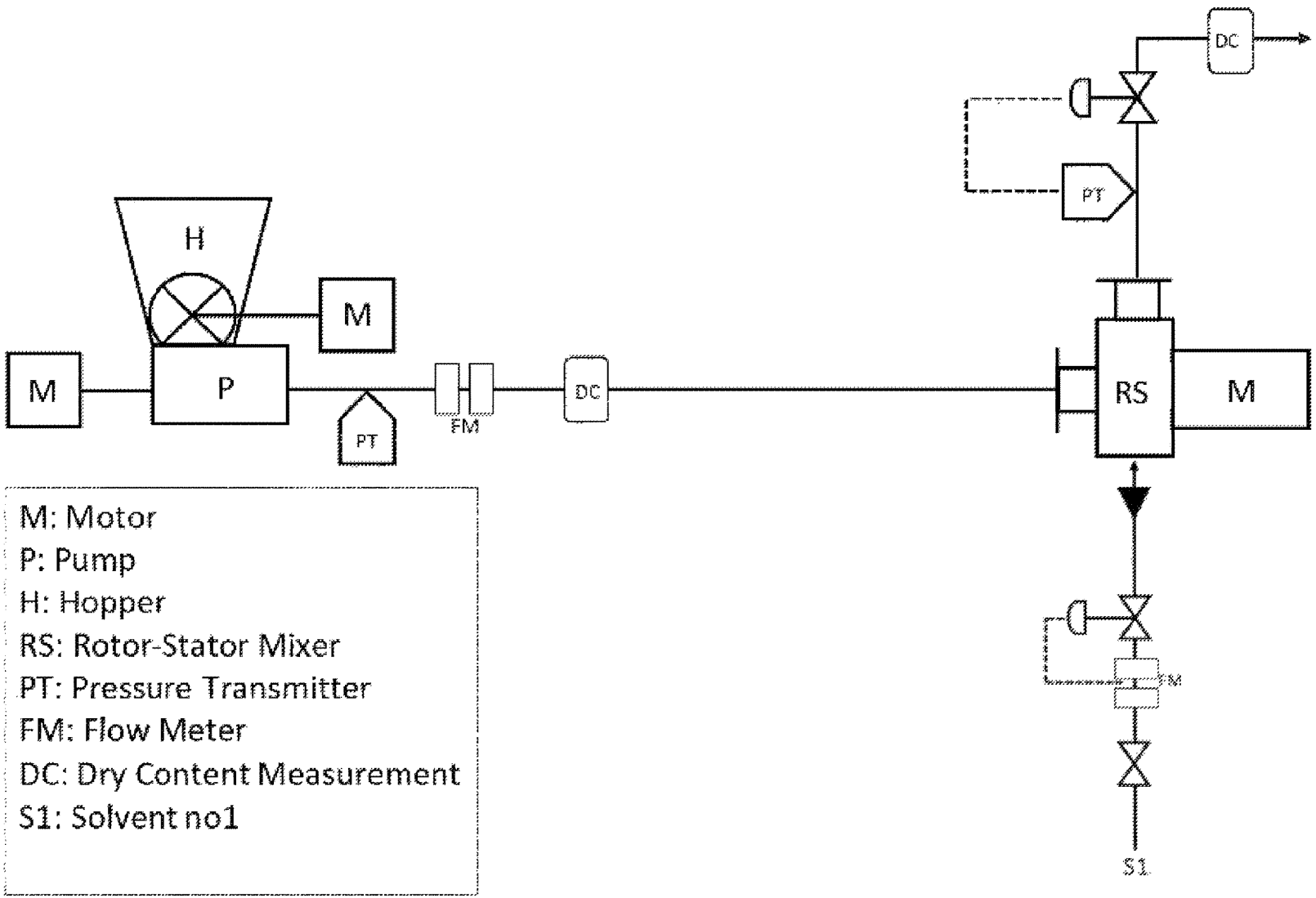
FIG. 7 shows an exemplary flow diagram of the process, including various components of the system, in accordance with the present invention.

The overall system is schematically and exemplarily illustrated in FIG. 4 and FIG. 7.

In embodiments of the invention, process solvent, preferably water (S1 or S2 or both) is loaded into the system, preferably through a manual valve and a flowmeter (FM) with a control valve. In front of the inlet, a check valve is preferably located prior to the entry into tubing of the system.

In embodiments the present invention, the at least one rotor-stator mixer (2) comprises a restriction element, preferably an adjustable valve downstream of the mixing volume segment of the rotor-stator mixer "Microfibrillated cellulose" (MFC) in accordance with the present invention is to be understood as relating to cellulose fibers that have been subjected to a mechanical treatment resulting in an increase of the specific surface and a reduction of the size of cellulose fibers, in terms of cross-section (diameter) and/or length, wherein said size reduction preferably leads to "fibrils" having a diameter in the nanometer range and a length in the micrometer range.

In cellulose, which is the starting product for producing microfibrillated cellulose (typically present as a "cellulose pulp"), no, or at least not a significant or not even a noticeable portion of individualized and "separated" cellulose "fibrils" can be found. The cellulose in wood fibres is an aggregation of fibrils. In cellulose (pulp), elementary fibrils are aggregated into microfibrils which are further aggregated into larger fibril bundles and finally into cellulosic fibres. The diameter of wood based fibres is typically in the range 10-50 μm (with the length of these fibres being even greater). When the cellulose fibres are microfibrillated, a heterogeneous mixture of "released" fibrils with cross-sectional dimensions and lengths from nm to μm may result. Fibrils and bundles of fibrils may co-exist in the resulting microfibrillated cellulose.

Microfibrillated cellulose consists of fibrils in constant interaction with each other in a three-dimensional network. The most important performance properties of MFC—high viscosity at rest, shear thinning (thixotropic) behavior, water holding capacity—are a result of the existence of this entangled network.

In the microfibrillated cellulose ('MFC') as described throughout the present disclosure, individual fibrils or fibril bundles can be identified and easily discerned by way of conventional optical microscopy, for example at a magnification of 40×.

In accordance with the present invention, the term "suspension" is understood to mean a liquid, in which solid particles (here: fibers) are dispersed, as generally understood by the skilled person and as defined in the IUPAC "Gold Book", [PAC, 1972, 31, 577 (*Manual of Symbols and Terminology for Physicochemical Quantities and Units, Appendix II: Definitions, Terminology and Symbols in Colloid and Surface Chemistry*); page 606].

Figure 1:
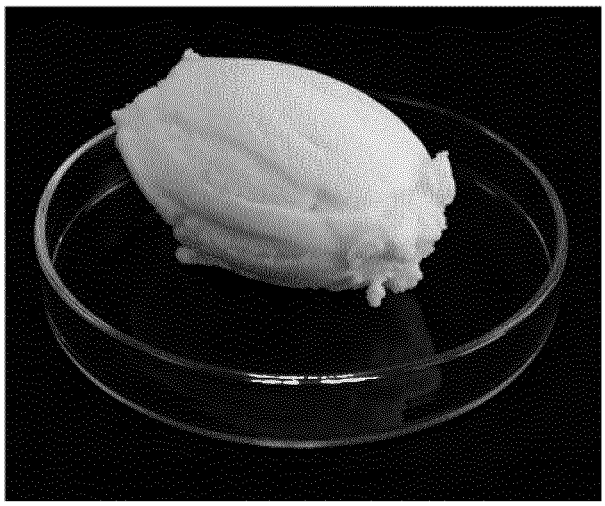
FIG. 1 shows microfibrillated cellulose at a dry matter content of approx. 8% to 10%; the "paste"-like structure of MFC is apparent.

In the present invention, the suspension of microfibrillated cellulose fibers in a solvent, has the consistence of a "paste" and shows non-Newtonian flow properties (see FIG. 1). Such a suspension/paste is sometimes also referred to as a "gel" (or "hydrogel" if the solvent is water).

In accordance with the present invention, the parameter "solids content" (sometimes also referred to as "dry matter") refers to the amount of MFC that remains once all the solvent (typically water) has been removed and is provided in % weight relative to the overall weight of the suspension comprising MFC and the solvent Unless indicated otherwise, any parameter referred to in the present disclosure is measured at standard conditions, i.e. at room temperature (20° C.), ambient pressure (1 bar) and 50% ambient humidity. Unless indicated otherwise, any ratio given for an amount of component of the overall system is meant to be given in % weight relative to the overall weigh of the content of the system (i.e. excluding packaging).

No limitations exist in regard to the solvent, as long as the solvent is capable to keep the MFC fibers in suspension under conditions typical for storage and transport.

In embodiments of the invention, the solvent is a hydrophilic solvent, preferably a polar solvent, further preferably a protic solvent. Preferred solvents are water or alcohol or any mixture of such solvents. In preferred embodiments the solvent essentially consists of water, i.e. comprises at least 90%, preferably at least 95%, further preferably at least 99% of water. "Water" can be distilled water, processed water or tab water as commonly used in industrial applications.

In embodiments of the invention, the solvent comprises additives such as glycols, glycerols, surfactants, preservatives or others. Two different solvents can be injected upstream, as shown in FIG. 4.

As already indicated above, in principle, any type of microfibrillated cellulose (MFC) may be used in accordance with the present invention, as long as the fiber bundles as present in the original cellulose pulp are sufficiently disintegrated in the process of making MFC so that the average diameter of the resulting fibrils is in the nanometer-range and therefore more surface of the overall cellulose-based material has been created, vis-b-vis the surface available in the original cellulose material. MFC may be prepared according to any of the processes described in the art, including the prior art specifically cited in the "Background"-Section above.

Origin of the Cellulose Used to Prepare the MFC

In accordance with the present invention, there is no specific restriction in regard to the origin of the cellulose, and hence of the microfibrillated cellulose. In principle, the raw material for the cellulose microfibrils may be any cellulosic material, in particular wood, annual plants, cotton, flax, straw, ramie, bagasse (from sugar cane), suitable algae, jute, sugar beet, citrus fruits, waste from the food processing industry or energy crops or cellulose of bacterial origin or from animal origin, e.g. from tunicates.

In a preferred embodiment, wood-based materials are used as raw materials, either hardwood or softwood or both (in mixtures). Further preferably softwood is used as a raw material, either one kind or mixtures of different soft wood types. Bacterial microfibrillated cellulose is also preferred, due to its comparatively high purity.

Modified (Derivatized) and Non-Modified (Un-Derivatized) Cellulose/MFC

In principle, the microfibrillated cellulose in accordance with the present invention may be unmodified in respect to its functional groups or may be physically modified or chemically modified, or both.

Chemical modification of the surface of the cellulose microfibrils may be achieved by various possible reactions of the surface functional groups of the cellulose microfibrils and more particularly of the hydroxyl functional groups, preferably by: oxidation, silylation reactions, etherification reactions, condensations with isocyanates, alkoxylation reactions with alkylene oxides, or condensation or substitution reactions with glycidyl derivatives. Chemical modification may take place before or after the defibrillation step.

The cellulose microfibrils may, in principle, also be modified by a physical route, either by adsorption at the surface, or by spraying, or by coating, or by encapsulation of the microfibril. Preferred modified microfibrils can be obtained by physical adsorption of at least one compound. The MFC may also be modified by association with an amphiphilic compound (surfactant).

However, in preferred embodiments, the microfibrillated cellulose is not physically modified.

In a preferred embodiment of the present invention, the microfibrillated cellulose is prepared by a process, which comprises at least the following steps:

(a) subjecting a cellulose pulp to at least one mechanical pretreatment step;

(b) subjecting the mechanically pretreated cellulose pulp of step (a) to a homogenizing step, which results in fibrils and fibril bundles of reduced length and diameter vis-á-vis the cellulose fibers present in the mechanically pretreated cellulose pulp of step (a), said step (b) resulting in microfibrillated cellulose;

wherein the homogenizing step (b) involves compressing the cellulose pulp from step (a) and subjecting the cellulose pulp to a pressure drop.

The mechanical pretreatment step preferably is or comprises a refining step. The purpose of the mechanical pretreatment is to "beat" the cellulose pulp in order to increase the accessibility of the cell walls, i.e. to increase the surface area.

Prior to the mechanical pretreatment step, or in addition to the mechanical pretreatment step, enzymatic (pre)treatment of the cellulose pulp is an optional additional step that may be preferred for some applications. In regard to enzymatic pretreatment in conjunction with microfibrillating cellulose, the respective content of WO 2007/091942 is incorporated herein by reference. Any other type of pretreatment, including chemical pretreatment is also within the scope of the present invention.

In the homogenizing step (b), which is to be conducted after the (mechanical) pretreatment step, the cellulose pulp slurry from step (a) is passed through a homogenizer at least once, preferably at least two times, as described, for example, in PCT/EP2015/001103, the respective content of which is hereby incorporated by reference.

In embodiments of the invention, microfibrillated cellulose as diluted according to any one of the embodiments described above is used in a wide variety of applications, including but not limited to coatings, adhesives, (surface) sizes, paints, inks, de-icing fluids or additives, thixotropic additives, emulsifier/emulsion aid; viscosity adjustment, additive in oil field applications, in particular drilling fluids, in home care/personal care/personal hygiene applications, cosmetics and pharmaceutical applications, in particular in ointments, emulsions or high viscosity liquids, as an additive or aid in medical devices or medical applications, in particular scar and wound care, agrochemicals, food applications, for example as thickener, dietary supplement, non-caloric additive, emulsifier etc., in printing applications, including 3-D printing, in composite materials, for example plastics, rubber or paper-based materials, cardboards etc., in or as porous material, foam or aerogel/hydrogel; in separation technologies, including filter elements, membranes, separators etc., in film forming applications, in battery technology and/or flexible electronics, in textile application and/or as filaments, including yarns, non-wovens, meshes etc., as an additive or adjuvant in construction commodities, including cement, concrete, gypsum boards, and the like.

EXAMPLES

Example 1

Preparation of Microfibrillated Cellulose

MFC as diluted in accordance with the present invention is commercially available and commercialized by Borregaard as "Exilva" based on cellulose pulp from Norwegian spruce (softwood).

The MFC in step (i) was present as a paste, having a solids content of 10%. The solvent was water.

The MFC was provided in two different qualities, named Exilva P and Exilva F. The differences between Exilva P and Exilva F are related mainly to the size of the aggregates of microfibrils and consequently to the 3D-network properties. Exilva "F" has higher Brookfield viscosity, surface area (water retention) and higher tensile strength than Exilva "P". While these differences have no relevance for the working of the present invention, diluting these two different microfibrillated cellulose materials shows that the method according to the present invention works for different "qualities" of microfibrillated cellulose (see FIGS. 5 and 6)

Example 2

Inline Dilution of 10% w/w MFC in Water to 2% w/w Using a Cavitron Reactor System MFC from Example 1 was continually diluted in a Cavitron® Reactor System as commercially available from Arde Barinco (NJ, USA).

The Cavitron in-line mixer was set up with a centrifugal pump for the water-supply line, and with a pump with a feeding-screw for continually feeding the Exilva paste into the head of the rotor-stator mixer (see FIG. 4 for further details).

Dilution of MFC from 10% w/w to 2% w/w in a Cavitron rotor-stator mixer was tested in two different trials. In the first trial, the maximum amount of water possible added into the system, was measured to be approximately 30 liters/min. This value was chosen to be the "High flow" setting. However, specification for the Cavitron rotor-stator mixture allow up to 90 liters/min. A larger water-inlet was welded onto the pipe, and an additional test was done with approximately 108 L/min.

The dilution was performed at three different flow-rates (total flow);

13 kg/min (800 kg/h)

37 kg/min (2200 kg/h)

108 kg/min (6500 kg/h)

At each flow-rate, three different settings for the Cavitron were tested;

Medium intensity (35 Hz) with 3 bars counter-pressure

High intensity (50 Hz) with 3 bars counter-pressure

High intensity (50 Hz) with open valve. With open valve, the pressure behind the mixing-head was measured to be from 0, 4 to 1 bar depending on the flow-rate.

Figure 5:
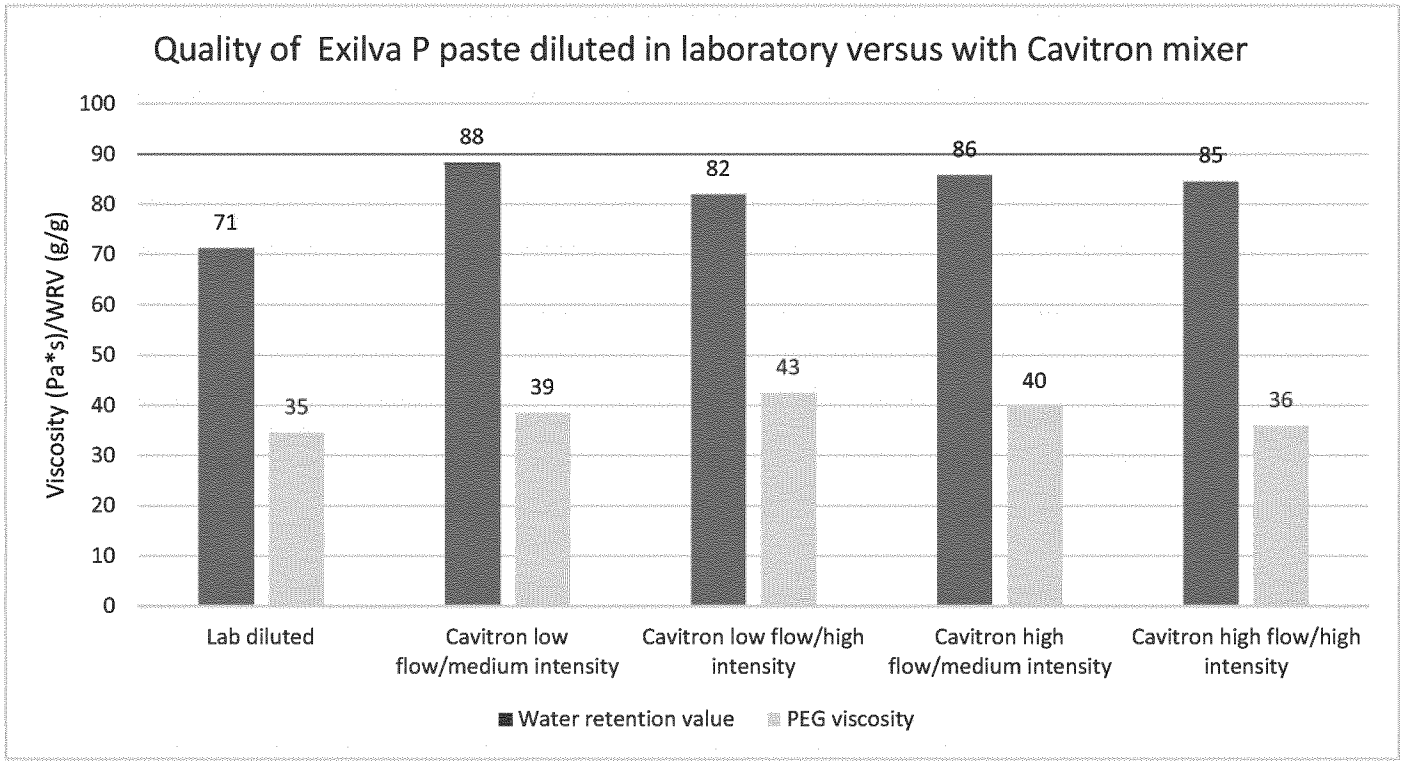
FIG. 5 shows a comparison of performance parameters for one batch of Exilva as obtained after dilution in a laboratory mixer (reference) compared to dilution using a process in accordance with the present invention.
Figure 6:
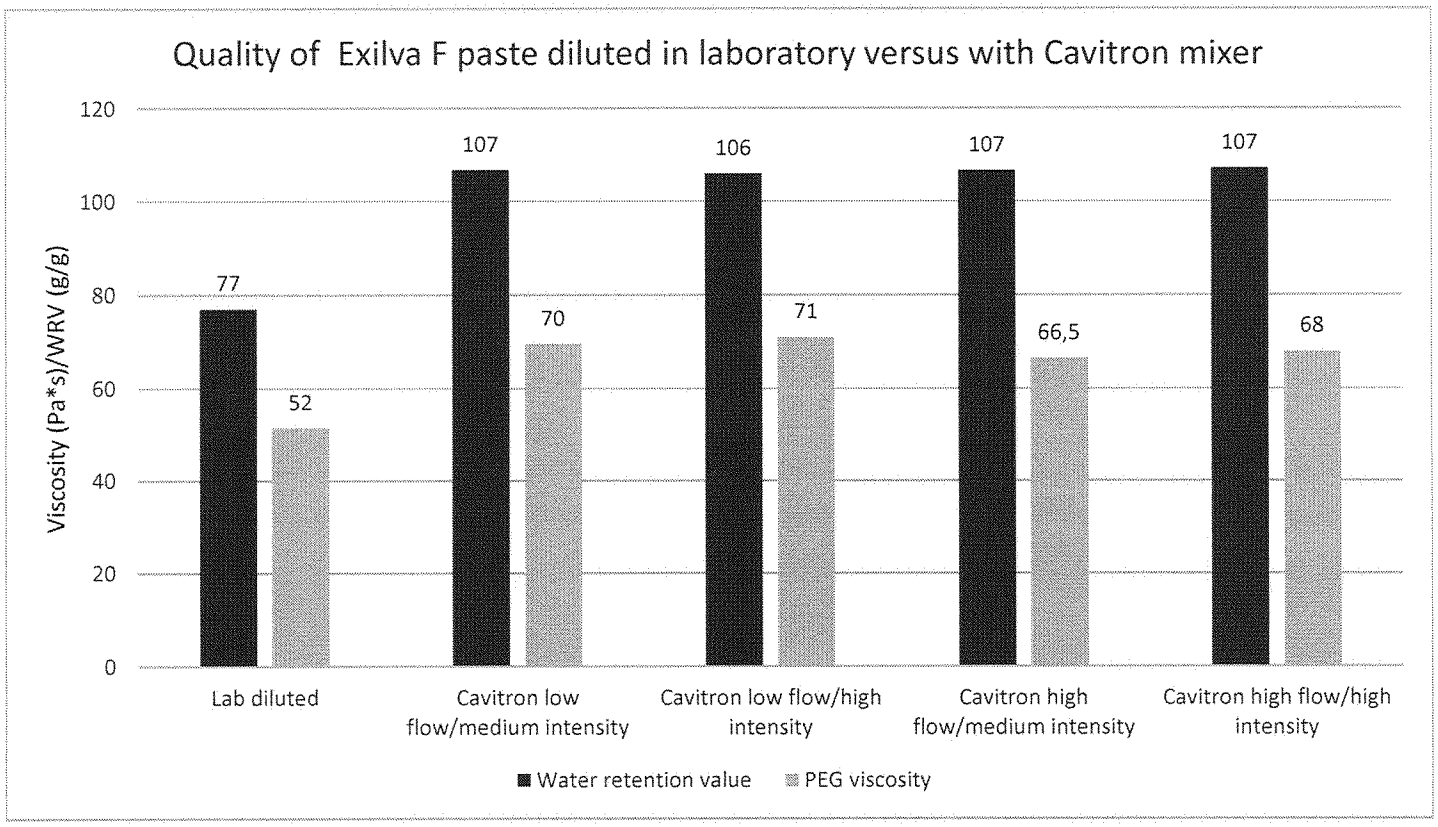
FIG. 6 shows the respective comparison of performance parameters for a higher viscosity Exilva batch as obtained after dilution in a laboratory mixer (reference) compared to dilution using a process in accordance with the present invention.

The results of these test runs are summarized in FIGS. 5 and 6, as well as the Table given below.

TABLE 1

Performance Parameters of MFC diluted in High intensity Rotor-Stator system vs conventional laboratory mixer (average of different settings)

| | increase |
|---|---|
| P | |
| WRV: | 20% |
| PEG visc: | 13% |
| F | |
| WRV: | 39% |
| PEG visc: | 33% |

In summary, all rotor-stator mixer-diluted samples achieved similar or higher quality than the lab-diluted, respectively using the same Exilva paste. Improvements were found in regard to water retention capacity and PEG viscosity, contrary to what is usually observed in conventional dilution processes.

The mixing intensity (35-50 Hz) did not influence the quality, except for the maximum flow-rate for the high quality Exilva paste (F), where the high intensity gave best quality of the product.

More specifically, the Rotor-stator mixer diluted samples with low or medium flow (800-2200 $m^3$/h) resulted in higher quality than the lab-diluted sample, The mixing intensity (35-50 Hz) did not noticeably influence the quality.

The Rotor-stator mixer diluted samples with high flow (6500 $m^3$/h) resulted similar or better quality than the lab-diluted sample. The best quality was obtained with high mixing intensity (50 Hz).

Example 3

Inline Dilution of 9% w/w MFC in Water Down to 6% w/w, Using a Cavitron Reactor System The aim of this experiment was to find a way to prepare a stable suspension of approx 6% microfibrillated cellulose (Exilva F). This experiment showed that a stable suspension with a solids content of 6% w/w can be obtained, even after 10 weeks of storage.

MFC from Example 1 was continually diluted in a Cavitron® Reactor System as commercially available from Arde Barinco (NJ, USA).

The Cavitron in-line mixer was combined with a centrifugal pump for the water-supply line, and with a pump with a feeding-screw for continually feeding the MFC paste into the head of the rotor-stator mixer (see FIG. 4 for further details).

Dilution of MFC, Exilva F, from 9% w/w to 6% w/w in a Cavitron rotor-stator mixer was tested with following settings:

Flow-rate (total flow);

9 kg/min (540 kg/h)

Cavitron settings;

High intensity (50 Hz)

3 bars counter-pressure

TABLE 1

Performance Parameters of MFC diluted in High intensity Rotor-Stator system vs conventional laboratory mixer (average of different settings).

| F | increase |
|---|---|
| WRV: | 15% |
| PEG visc: | 0% (similar) |

In summary, the rotor-stator mixer-diluted sample achieved similar or higher quality in regard to the suspension than the lab-diluted but otherwise same MFC paste. Improvements were found in regard to water retention capacity, contrary to what is usually observed in conventional dilution processes.

The invention claimed is:

1. A method for dilution of microfibrillated cellulose (MFC), from a solids content in the range of 5% weight by weight ("w/w")-50% w/w down to a solids content of below 7% w/w, wherein said process at least comprises the following steps:

(i) providing microfibrillated cellulose in a solvent, wherein the solids content is in the range of 5% weight by weight ("w/w")-50% w/w;

(ii) subjecting said microfibrillated cellulose from step (i) to a dilution step in a rotor-stator mixer, which comprises a series of concentric rings or chambers comprising at least one rotor and at least one stator;

(iii) simultaneously to step (ii): injecting solvent into the rotor-stator mixer in order to lower the solids content of the microfibrillated cellulose in the rotor-stator mixer, wherein the dilution step of step (ii) occurs in a volume segment defined between the at least one stator and the at least one rotor.

2. The method according to claim 1, wherein, in step (ii), the microfibrillated cellulose is subjected to an energy input of from 1 kWh/ton dry MFC-1000 kWh/ton dry MFC.

3. The method according to claim 1, wherein, in step (ii), a retention time of the MFC in the rotor-stator mixer is from 0.01 to 30 sec.

4. The method according to claim 1, wherein a tip speed of rotors in the rotor-stator mixer is from 10 m/s to 100 m/s.

5. The method according to claim 4, wherein the tip speed of the rotors in the rotor-stator mixer is from 30 m/s to 60 m/s.

6. The method according to claim 1, wherein step (ii) leads to an increase in polyethylene glycol (PEG) viscosity.

7. The method according to claim 1, wherein a water retention capacity of the microfibrillated cellulose after step (ii) is higher than a water retention capacity of the microfibrillated cellulose as initially provided in step (i).

8. The method according to claim 1, wherein said microfibrillated cellulose comprises "fibrils" having a diameter in a nanometer range and a length in a micrometer range.

9. The method according to claim 8, wherein the microfibrillated cellulose is not physically modified.

10. The method according to claim 1, wherein the solvent essentially consists of water such that the solvent comprises at least 90% of water.

11. The method according to claim 1, wherein the microfibrillated cellulose is prepared by a process, which comprises at least the following steps:

(a) subjecting a cellulose pulp to at least one mechanical pretreatment step;

(b) subjecting the mechanically pretreated cellulose pulp of step (a) to a homogenizing step, which results in fibrils and fibril bundles of reduced length and diameter vis-à-vis the cellulose fibers present in the mechanically pretreated cellulose pulp of step (a), said step (b) resulting in microfibrillated cellulose;

wherein the homogenizing step (b) involves compressing the cellulose pulp from step (a) and subjecting the cellulose pulp to a pressure drop.

12. The method according to claim 1, wherein the solids content of the microfibrillated cellulose is diluted from in the range of 5% w/w-50 w/w down to a solids content of below 5 w/w.

13. The method according to claim 1, wherein the solids content of the microfibrillated cellulose is diluted from in the range of 5% w/w-50 w/w down to a solids content of 0.01% w/w-5% w/w.

* * * * *